US006423156B1

(12) United States Patent
Günther et al.

(10) Patent No.: US 6,423,156 B1
(45) Date of Patent: Jul. 23, 2002

(54) PROCESS FOR THE COATING OF ELECTRICAL STEEL STRIPS WITH AN ANNEALING SEPARATOR

(75) Inventors: Klaus Günther, Voerde; Heiner Schrapers, Duisburg, both of (DE)

(73) Assignee: EBG Gesellschaft für Elektromagnetische Werkstoffe mbH, Bochum (DE)

( * ) Notice: Subject to any disclaimer, the term of this patent is extended or adjusted under 35 U.S.C. 154(b) by 0 days.

(21) Appl. No.: 09/554,405

(22) PCT Filed: Sep. 18, 1998

(86) PCT No.: PCT/EP98/05960

§ 371 (c)(1),
(2), (4) Date: Jun. 6, 2000

(87) PCT Pub. No.: WO99/24639

PCT Pub. Date: May 20, 1999

(30) Foreign Application Priority Data

Nov. 12, 1997 (DE) ..... 197 50 066

(51) Int. Cl.[7] ..... H01F 1/00
(52) U.S. Cl. ..... 148/122; 148/113
(58) Field of Search ..... 148/113, 122

(56) References Cited

U.S. PATENT DOCUMENTS

| | | | | | |
|---|---|---|---|---|---|
| 3,950,575 | A | * | 4/1976 | Kitayama et al. | 427/226 |
| 4,543,134 | A | * | 9/1985 | Tanaka | 148/113 |
| 5,685,920 | A | * | 11/1997 | Tanaka et al. | 148/113 |
| 5,863,356 | A | * | 1/1999 | Bolling et al. | 148/122 |

FOREIGN PATENT DOCUMENTS

| | | | |
|---|---|---|---|
| DE | 24 02 960 | A | 7/1974 |
| DE | 34 40 344 | A | 7/1985 |
| DE | 44 09 691 | A | 9/1995 |
| EP | 0416420 | A2 * | 3/1991 |

OTHER PUBLICATIONS

The Condensed Chemical Dictionary, 8th Edition, 1971, pp. 51 and 809, Pulisher:Van Nostrand Reinhold Co., NY.*

* cited by examiner

*Primary Examiner*—John Sheehan
(74) *Attorney, Agent, or Firm*—Proskauer Rose LLP

(57) ABSTRACT

The invention relates to a process for the coating of electric steel strips with an oxide powder as annealing separator by the application of an aqueous solution which contains mainly MgO and also at least one additive, including a chlorine-containing compound. The characterizing feature of the invention is that the additive added to the aqueous solution is ammonium chloride ($NH_4Cl$ or $NH_4Cl.nH_2O$).

5 Claims, 2 Drawing Sheets

Figure 1:
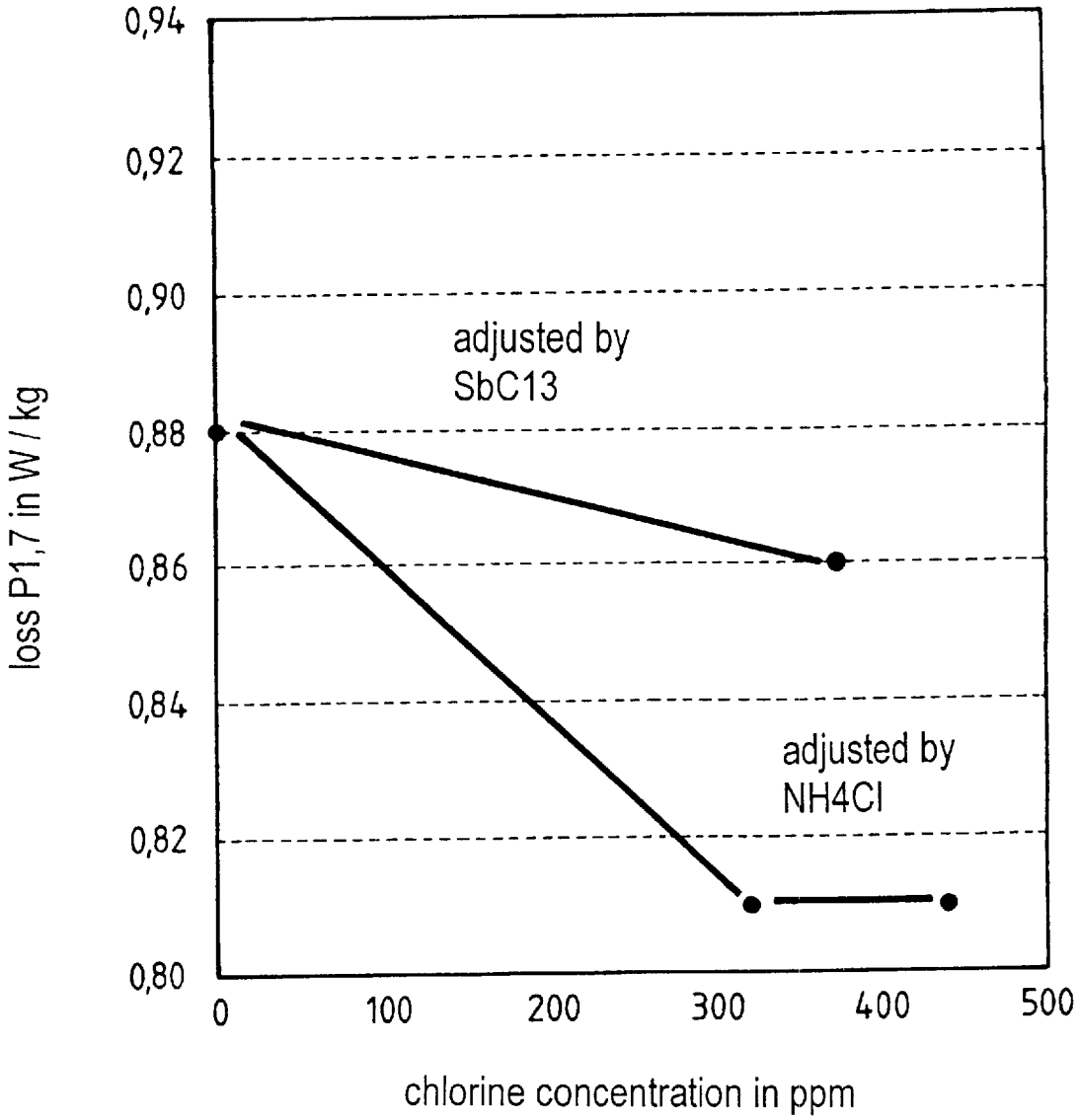

Influence of the raised Na and C1 concentrations in the adhesion protection on the magnetic properties of highly permeable electric quality sheet of thickness 0.27 mm Influence of chlorine concentration in the adhesion protection, adjusted by antimony chloride/ammonium chloride, on the magnetic properties of grain-oriented electric quality sheet of nominal thickness 0.23 mm Influence of the raised Na and C1 concentrations in the adhesion protection on the magnetic properties of highly permeable electric quality sheet of thickness 0.27 mm

PROCESS FOR THE COATING OF ELECTRICAL STEEL STRIPS WITH AN ANNEALING SEPARATOR

The invention relates to a process for the coating of electric steel strips with an oxide powder as annealing separator by the application of an aqueous solution which contains mainly MgO and also at least one additive, including a chlorine-containing compound.

Electric steel strips are conventionally produced by melting the alloy, casting a slab, hot rolling the slab, annealing the hot strip for the establishment of the inhibitor phase, cold rolling the hot strip, decarburisation annealing of the cold strip, and the application of an adhesion separator mainly consisting of MgO as an adhesion protection in the following final annealing of the coiled electric steel strip for secondary recrystallisation.

Grain-oriented electric quality sheets from silicon steel strips, which due to their use in transformers must have a texture permitting ready magnetisability in the rolling direction (Goss texture) are alloyed with grain growth inhibitors, such as Al and N, Mn and S, Cu and S, Mn and Se. These form compounds such as AlN, MnS, CuS, MnSe which, precipitated finely dispersed, prevent premature growth of the grains during the recrystallisation annealings. As a result, a preferred growth of Goss-oriented grain is produced during secondary recrystallisation.

As uniform a finely dispersed distribution of the particles as possible is of importance for the grain-growth-limiting effect of the inhibitors. This takes place during the hot strip annealing and/or during a nitrogen content increasing process to be performed following decarburisation. Inhibitor distribution can still be influenced until shortly before the start of selective grain growth. It is ascertained knowledge that the composition of the annealing separator has a special importance also for the distribution of the grain growth inhibitors. Small quantities of other substances have therefore been added to the substantially magnesium oxide annealing separator to improve the surface, increase polarisation and reduce remagnetisation loss.

DE 29 47 945 C2 recommends the addition of boron and sodium compounds, while EP 0 232 537 B1 recommends the addition of titanium, boron or sulphur compounds. At first the addition of chlorides was generally considered to be harmful. However, according to DE 344 40 344, the addition of antimony sulphate in combination with Sb, Sr, Ti or Zr chloride is supposed to produce improvements in magnetic properties. However, antimony sulphate is poorly soluble in water and moreover toxic. According to the idea of DE 44 09 691 A1 a satisfactorily water-soluble sodium compound or a finely dispersed oxidic aluminium compound should be added, while a metal chloride can additionally be added. EP 0 789 093 A1 discloses halogens or halides as additives. According to EP 0 416 420 A2 a clearly-defined chlorine content should be adjusted in the annealing separator by the addition of Mg, Ca, Na and/or K chlorides. A disadvantage of the chlorides listed in the citations is that together with them elements are introduced which leave behind on the strip surface interfering solid residues after the long-time annealing.

It is an object of the invention to prevent the premature degradation of nitridic and/or sulphidic inhibitors during the heating phase for the final annealing, or to re-form nitridic inhibitors in this phase. The inhibitors are decisively influenced in this phase via reactions of the annealing gas with the basic material or the inhibitors contained therein. The composition of the annealing separator plays an essential part.

To solve this problem, in the process of the kind specified according to the invention the additive added to the aqueous solution is ammonium chloride ($NH_4Cl$ or $NH_4Cl.nH_2O$). The quantity of additive is so selected that the chlorine concentration, referred to the proportion of MgO by weight in the annealing separator, is 0.01 to 0.10% by weight, preferably 0.02 to 0.05% by weight.

Another additive according to the invention can be sodium pyrophosphate, preferably added in a quantity such that the sodium concentration, referred to the proportion of MgO in the annealing separator, is adjusted at 0.02 to 0.05% by weight.

The substances added according to the invention to the annealing separator so control layer formation that the glass film is formed at low temperatures and has such a high density as to prevent any interaction in the electric steel strip between the annealing gases and the inhibitors.

The performance of the process according to the invention not only improves the remagnetisation loss, but also clearly enhances the sharpness of orientation—i.e., achieves a pronounced Goss texture and thereby great potential improvement via a domain refinement to be performed on the finished strip, for example, by laser treatment. There are also advantages with regard to ready availability of the additives provided, their satisfactory water solubility, cheap and simple performability and also toxicological and ecological compatibility.

The concentrations of chlorine and sodium in the annealing separator are adjusted independently of one another in the process according to the invention. Chlorine and sodium are introduced into the aqueous solution in the form of various compounds, thus ensuring the independent optimisation of the particular concentration of chlorine or sodium.

One special advantage of the addition according to the invention of chlorine and possibly sodium to the annealing separator in the case of highly permeable electric quality plate is that the magnetic properties clearly react less strongly to differences in conditions during the final annealing. Since the final annealing is performed in the coil, it is unavoidable that differences will occur in the annealing conditions in the transverse and longitudinal directions of the strip. The differences in the annealing conditions more particularly relate to the dew point of the annealing gas. The magnesium oxide, applied in the form of an aqueous slurry and then dried, inevitably contains a proportion of magnesium hydroxide. During the heating-up phase of the final annealing, the magnesium hydroxide is decomposed thermally into magnesium oxide and water. The water released raises the dew point of the annealing gas. An unfavourable dew point may lead to a negative effect on inhibitor distribution.

The selection of ammonium chloride as the chlorine dispenser for the annealing separator has particular importance and two decisive advantages in comparison with other known chlorine compounds. On the one hand, in the thermal conditions of the final annealing the bonding partner of the chlorine can be conveyed away via the gaseous phase in an environmentally friendly manner, without leaving solid residues behind. Furthermore, as mentioned hereinbefore, the premature degradation of nitridic inhibitors in the electric steel strip must be prevented. Ammonium chloride meets both conditions in an outstanding manner. The $NH_3$ group is thermally separated during the final annealing. This gas moreover increases the nitrogen partial pressure between the coil windings as a precondition for the avoidance of a degradation of nitridic inhibitors in the steel strip and is then decomposed into harmless $N_2$ and $H_2$.

A further improvement of magnetic properties can be achieved by the use of sodium pyrophosphate as another additive to the annealing separator. Sodium pyrophosphate boosts the property-enhancing effect of the addition of chlorine. It also counteracts any distinct increase in the nitrogen content of the steel strip.

The invention will now be explained in greater detail from the following Examples.

EXAMPLE 1

In the industrial production of highly permeable grain-oriented electric quality sheets of thickness 0.23 mm the chlorine concentrations were adjusted by ammonium chloride and for comparison by antimony chloride as additives to the annealing separator.

TABLE 1

| Chlorine concentration in ppm, referred to MgO in the annealing separator | | |
|---|---|---|
| | $NH_4Cl$ | $SbCl_3$ |
| proportion in MgO | 200 | 200 |
| from additive | 120/240 | 170 |
| total Cl | 320/440 | 370 |

FIG. 1 shows the results on the basis of the remagnetisation loss $P_{1.7}$. The magnetic properties are clearly improved by the adjustment of the chlorine concentration according to the invention by ammonium chloride in comparison with the use of antimony chloride.

EXAMPLE 2

In the industrial production of highly permeable grain-oriented electric quality sheets of thickness 0.30 mm the chlorine and sodium concentrations were adjusted to the following values by the additives ammonium chloride and sodium pyrophosphate:

TABLE 2

| Cl and Na concentrations in ppm | | |
|---|---|---|
| | Cl | Na |
| proportion in MgO | 200 | 20 |
| from $NH_4Cl$ | 144 | |
| from $Na_4P_2O_7$ | | 280 |
| total | 344 | 300 |

Table 3 shows the results on the basis of the remagnetisation loss $P_{1.7}$.

TABLE 3

| Remagnetisation loss $P_{1.7}$ in W/kg | | |
|---|---|---|
| laser treatment of the finished strip | without additive | with Na and Cl |
| without | 1.06 | 0.99 |
| with | 1.02 | 0.89 |

The magnetic properties are clearly improved by the adjustment according to the invention of the sodium and chlorine concentrations. The remagnetisation loss decreases by approximately 7%. The effectiveness of a laser treatment carried out on the finished strip for domain refinement is particularly great with the Na and Cl concentrations in the annealing separator adjusted according to the invention.

EXAMPLE 3

In the industrial production of highly permeable grain-oriented electric quality sheets of thickness 0.27 mm the chlorine and sodium concentrations in the annealing separator were adjusted successively to the following values by the addition of ammonium chloride and-sodium pyrophosphate:

TABLE 4

| Cl and Na concentrations in ppm | | |
|---|---|---|
| | Cl | Na |
| proportion in MgO | 200 | 20 |
| from $NH_4Cl$ | 275 | |
| from $Na_4P_2O_7$ | | 280 |
| total | 475 | 300 |

Table 5 shows the results on the basis of the remagnetisation loss $P_{1.7}$.

TABLE 5

| Remagnetisation loss $P_{1.7}$ in W/kg | | |
|---|---|---|
| laser treatment of finished strip | with Cl (from $NH_4Cl$) | with Cl and Na (from $NH_4Cl$ or $Na_4P_2O_7$) |
| without | 0.91 | 0.88 |
| with | — | 0.77 |

Figure 2:
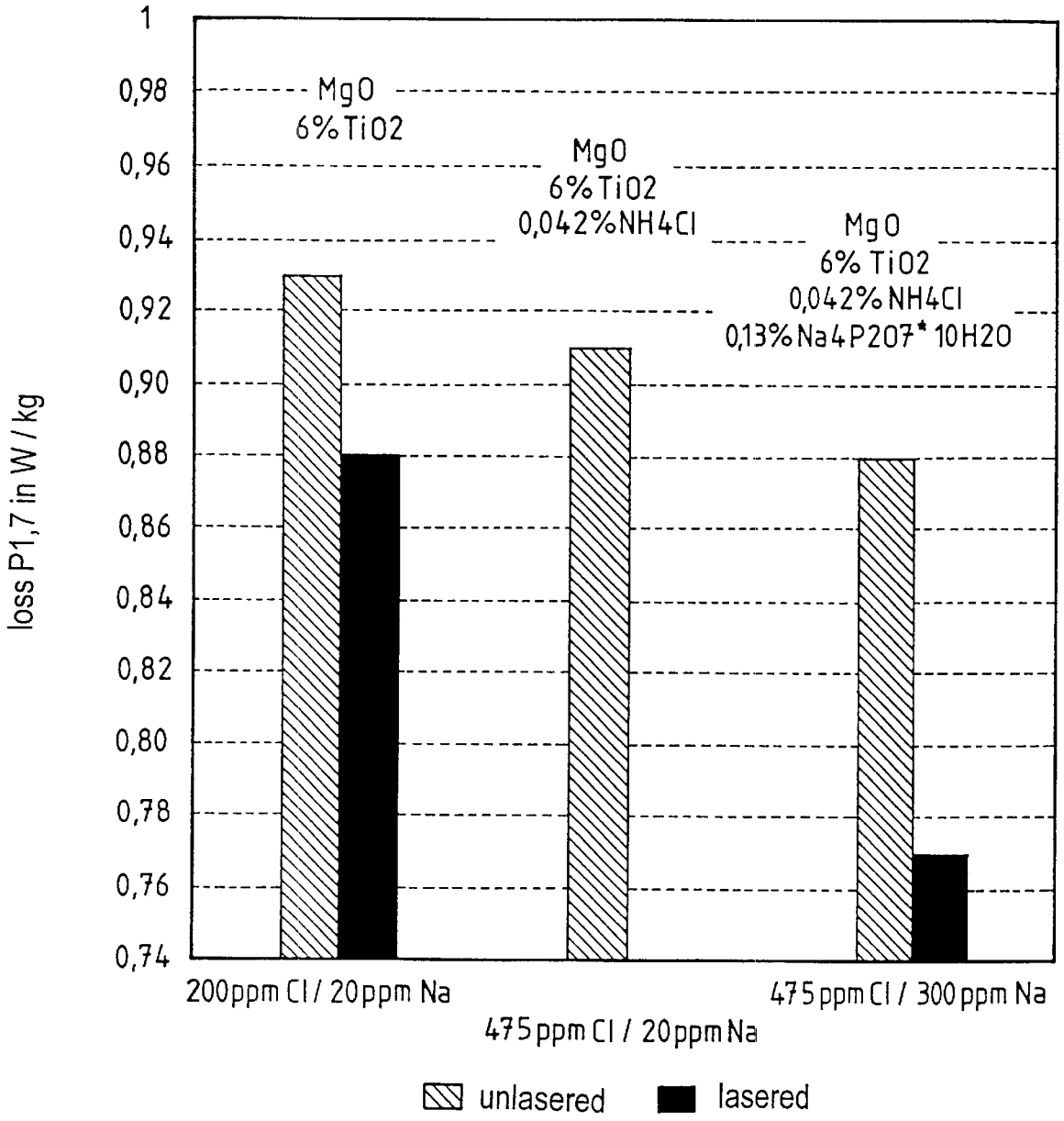

The remagnetisation loss $\mu$m is reduced by approximately 2% by the adjustment of the chlorine concentrations according to the invention. An additional adjustment of the sodium concentration according to the invention reduces the loss by a further 3%. The effectiveness of a laser treatment is clearly enhanced, as FIG. 2 demonstrates.

What is claimed is:

1. A process for coating electric steel strips comprising:

applying an annealing separator in an aqueous solution, the aqueous solution comprising MgO and at least one additive containing a chlorine-containing compound, wherein the at least one additive is ammonium chloride ($NH_4Cl$ or $NH_4Cl.nH_2O$).

2. A process according to claim 1, wherein enough ammonium chloride is added to the aqueous solution wherein chlorine concentration in the annealing separator is in the range of 0.01 to 0.10% by weight, relative to the weight of MgO.

3. A process according to claim 2, wherein the chlorine concentration is in the range of 0.02 to 0.05% by weight, relative to the weight of MgO.

4. A process according to claim 1, wherein sodium pyrophosphate ($Na_4P_2O_7$ or $Na_4P_2O_7.nH_2O$) is added to the aqueous solution.

5. A process according to claim 4, wherein sodium pyrophosphate concentration is in the range of 0.02 to 0.05% by weight, relative to the weight of MgO.

* * * * *